US005622364A

United States Patent [19]

Dutton et al.

[11] Patent Number: 5,622,364

[45] Date of Patent: Apr. 22, 1997

[54] APPARATUS AND METHOD OF DETERMINING A MEDIA LEVEL IN A SUPPLY TRAY

[75] Inventors: Todd A. Dutton; Scott S. Williams; Phillip B. Wright, all of Lexington, Ky.

[73] Assignee: Lexmark International, Inc., Lexington, Ky.

[21] Appl. No.: 624,772

[22] Filed: Mar. 27, 1996

[51] Int. Cl.[6] ..... B65H 7/02; B65H 3/06

[52] U.S. Cl. ..... 271/117; 271/110; 271/258.01; 271/258.04

[58] Field of Search ..... 271/10.02–10.03, 271/110, 111, 117, 118, 265.02, 265.01, 258.01, 258.04, 258.03, 259; 377/8

[56] References Cited

U.S. PATENT DOCUMENTS

| | | | |
|---|---|---|---|
| 3,580,567 | 5/1971 | Hashimoto | 271/62 |
| 4,508,338 | 4/1985 | Nishio | 271/118 |
| 4,535,463 | 8/1985 | Ito et al. | 271/110 X |
| 4,589,645 | 5/1986 | Tracy | 271/3.1 |
| 4,770,403 | 9/1988 | Katsumata et al. | 271/9 |
| 4,815,725 | 3/1989 | Kanaya | 271/258.01 |
| 4,928,949 | 5/1990 | Ramsey et al. | 271/111 |
| 4,960,272 | 10/1990 | Wierszewski et al. | 271/3.1 |
| 4,970,544 | 11/1990 | Furusawa et al. | 355/24 |
| 5,078,378 | 1/1992 | Kapadia et al. | 271/3.1 |
| 5,079,772 | 1/1992 | Ogawa | 395/111 |
| 5,081,595 | 1/1992 | Moreno et al. | 395/111 |
| 5,096,180 | 3/1992 | Nagaoka et al. | 271/110 |
| 5,121,914 | 6/1992 | Hargreaves | 271/110 |
| 5,237,644 | 8/1993 | Shinohara | 395/111 |
| 5,264,864 | 11/1993 | Hollman et al. | 346/1.1 |

FOREIGN PATENT DOCUMENTS

| | | | |
|---|---|---|---|
| 197345 | 9/1986 | Japan | 271/110 |
| 154555 | 6/1988 | Japan | 271/110 |
| 180629 | 7/1988 | Japan | 271/258.01 |
| 267233 | 10/1989 | Japan | 271/110 |
| 275334 | 11/1989 | Japan | 271/110 |
| 183599 | 7/1994 | Japan | 271/110 |

*Primary Examiner*—Boris Milef
*Attorney, Agent, or Firm*—Ronald K. Aust

[57] ABSTRACT

Apparatus and method is provided for determining a relative vertical position of a media sheet within a supply tray by sensing a picked sheet traveling through a media path, and therefrom determining time and/or distance traveled by the picked sheet. The vertical position of the media sheet within the supply tray is translated into a relative media level in the supply tray.

28 Claims, 3 Drawing Sheets

APPARATUS AND METHOD OF DETERMINING A MEDIA LEVEL IN A SUPPLY TRAY

BACKGROUND OF THE INVENTION

1. Field of the Invention

The present invention relates to an image forming apparatus, and, more particularly, to an image forming apparatus capable of detecting a paper level in a paper supply tray.

2. Description of the Related Art

An image forming apparatus, such as an electrophotographic printer, may include a supply tray which holds print media, such as paper. The media is held in the supply tray until a print job is requested, and is transported to an electrophotographic (EP) assembly within the printer where a latent image is transferred thereto. The media sheets are usually intended to be transported one by one from the supply tray and through a paper path to the EP assembly.

A supply tray of an image-forming apparatus can be variously configured. For example, one known configuration includes a supply tray having a bottom plate which is spring loaded from the bottom and biased in an upwardly direction. The spring loaded bottom plate biases a paper stack disposed within the supply tray in an upwardly direction against a comer buckler. A picker assembly, which may include a pick roller, engages the top of the top sheet of the paper stack and moves the top sheet into the paper path.

Another type of known supply tray includes a ramped surface or dam at an end thereof which is adjacent to the paper path in the printer. The paper in the supply tray is not biased in an upwardly direction, but rather merely lays on the bottom of the supply tray. A picker assembly includes a picker which engages the top of the top sheet in the paper stack and moves the top sheet up the dam and into the paper path of the printer.

A user of an image forming apparatus including a supply tray may find it desirable to be alerted as to the status of the number of media sheets (or paper level) within the supply tray either before or during a print job. For example, if a supply tray has a capacity of 200 sheets, it may be desirable for a user to be aware that the supply tray is approximately half full, or has approximately 100 sheets therein. Further, it may be desirable for a user to be alerted that the supply tray is nearly empty so that it may be replenished prior to a print job. Moreover, it may be desirable for a user to know that the number of printed pages in a requested print job is larger than the approximate number of sheets in the supply tray.

Various methods and apparatus exist for determining the approximate paper level within a supply tray. All such conventional paper level indicators require relatively expensive additional hardware to be added to the printer to sense the paper level, thereby increasing the cost of the printer. Generally, these methods and apparatus are used in conjunction with a supply tray wherein the paper rests directly on the bottom of the supply tray. For example, one method uses an arm which rests on the top of the paper stack and uses hardware to detect the angle of the arm. Such methods for determining a paper level in a supply tray utilize an arm which directly rests on top of a paper stack in the supply tray.

Further, it is also known to provide a paper level indicator wherein a stack of paper is disposed within a feeder module such that the trailing edges of the paper sheets are disposed at an acute angle relative to a bottom surface of the feeder module. A light source is disposed on top of the feeder module and a sensor is disposed on the bottom of the feeder module. As the sheets in the paper stack are used, more of the light which is output by the light source is received by the sensor. The sensor operates a suitable electrical circuit providing a "low" warning to a user when the height of the stack is such that the sensor is substantially exposed. Such an apparatus is disclosed in U.S. Pat. No. 4,928,949 (Ramsey, et al). Such an apparatus does not utilize an arm which rests upon the top of the paper stack within the supply tray, but still requires the use of multiple coacting sensors, thereby adding to the cost of the printer.

What is needed in the art is an apparatus for detecting a paper level in a supply tray which does not require a substantial amount of additional hardware.

SUMMARY OF THE INVENTION

The present invention provides an apparatus including a processor which is connected to a registration sensor disposed in a paper path and to a picker assembly. The processor controls operation of a sheet picker of the picker assembly and receives a signal from the sensor indicating that a picked sheet is present. The processor determines the relative position of an uppermost sheet in a supply tray based upon an initial actuation of the sheet picker and the sensing of the picked sheet by the sensor. The relative position of the uppermost sheet maybe determined based upon elapsed time, or based upon the distance the picked sheet travels to reach the sensor.

The invention comprises, in one form thereof, an apparatus which includes a supply tray for holding a plurality of the media sheets. The apparatus defines a media path through which a media sheet travels. A picker assembly includes a movable picker which is configured to move the media sheet into the media path. A sensor is disposed in association with the media path at a particular location, and is adapted to detect a media sheet traveling through the media path and to provide an output signal. A processor connected to each of the picker assembly and the sensor controls movement of the movable picker and receives the sensor output signal. The processor determines a relative position of an uppermost sheet of a remainder of the plurality of media sheets with respect to the base of the supply tray based on an initial actuation of the sheet picker to pick the picked sheet and the sensing of the picked sheet by the sensor.

An advantage of the present invention when incorporated, for example, into an imaging apparatus, is that no additional hardware is required over the hardware normally present in the imaging apparatus.

Another advantage is that only a single sensor is required, which may be placed at one of a number of selected locations in the paper path.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
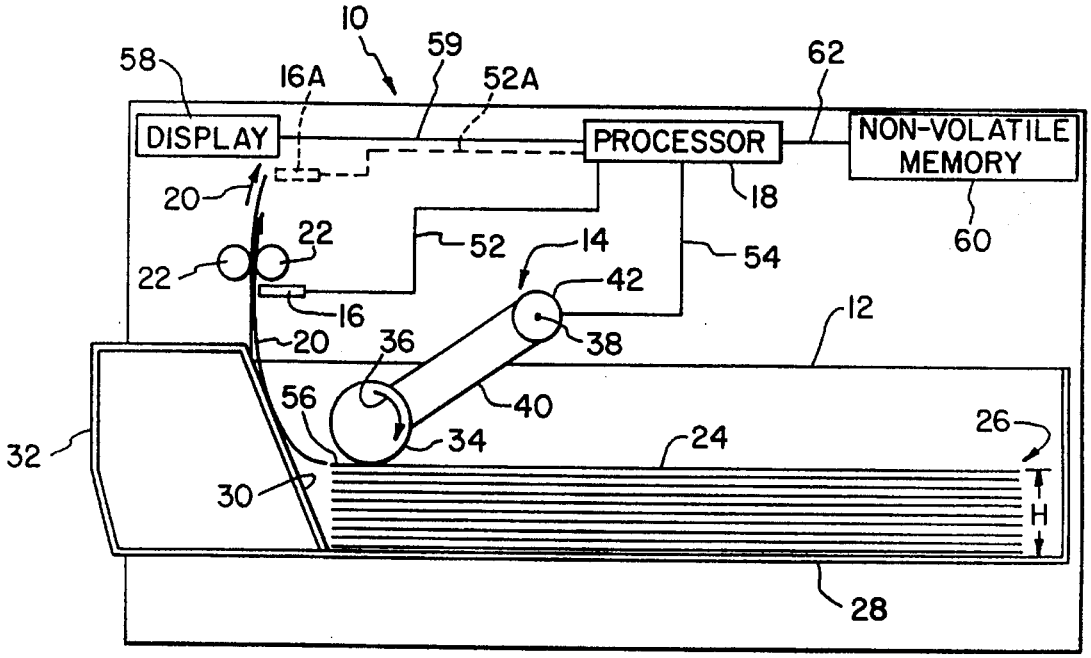
FIG. 1 is a schematical, side view of an embodiment of the present invention.

Referring now to the drawings, and particularly to FIG. 1, there is shown an embodiment of an image forming apparatus 10 of the present invention, which is in the form of an electrophotographic printer. Printer 10 includes a supply tray 12, picker assembly 14, sensor 16 and processor 18. Printer 10 also defines a media path, or paper path, through which media sheets travel, as indicated generally by arrow 20. A plurality of rollers, such as rollers 22, may be disposed within printer 10 along paper path 20 for guiding and/or feeding a sheet through paper path 20.

Supply tray 12 includes a plurality of media sheets or paper sheets 24 defining a media stack 26 which is disposed within supply tray 12. Media sheets 24 can be in the form of various types of print media, as is known. Media stack 26 rests directly on a bottom 28 of supply tray 12. It is thus apparent that a media sheet 24 is drawn from the top of media stack 26, which in turn diminishes in height. A ramped surface or dam 30 is disposed at an end of supply tray 12 adjacent to paper path 20. In the embodiment shown, dam 30 is disposed adjacent to the end of supply tray 12 which defines a handle 32 allowing a user to insert or remove supply tray 12 from printer 10. Dam 30 is positioned at an angle relative to bottom 28 such that a media sheet 24 which is pushed thereagainst by picker assembly 14 is deflected in an upward direction indicated by paper path 20.

Picker assembly 14 includes a movable picker 34 which rests on top of a top media sheet 24 of media stack 26. Picker 34, in the embodiment shown, is in the form of a pick roller which rotates as indicated by arrow 36 to move a media sheet 24 into paper path 20. More particularly, pick assembly 14 is pivotable about a pivot point 38 such that pick roller 34 is caused by gravitational force to rest against a top media sheet 24. A drive train housing 40 includes a plurality of gears, pulleys, belts or the like for transferring rotational power from a power source to pick roller 34. The power source may be in the form of a motor, such as a stepper motor 42, forming a part of picker assembly 14; or may be in the form of a separate motor (not shown) which is coupled to picker assembly 14 using a clutch or the like. Stepper motor 42 is connected to and controlled by processor 18 via conductor 54.

Figure 2:
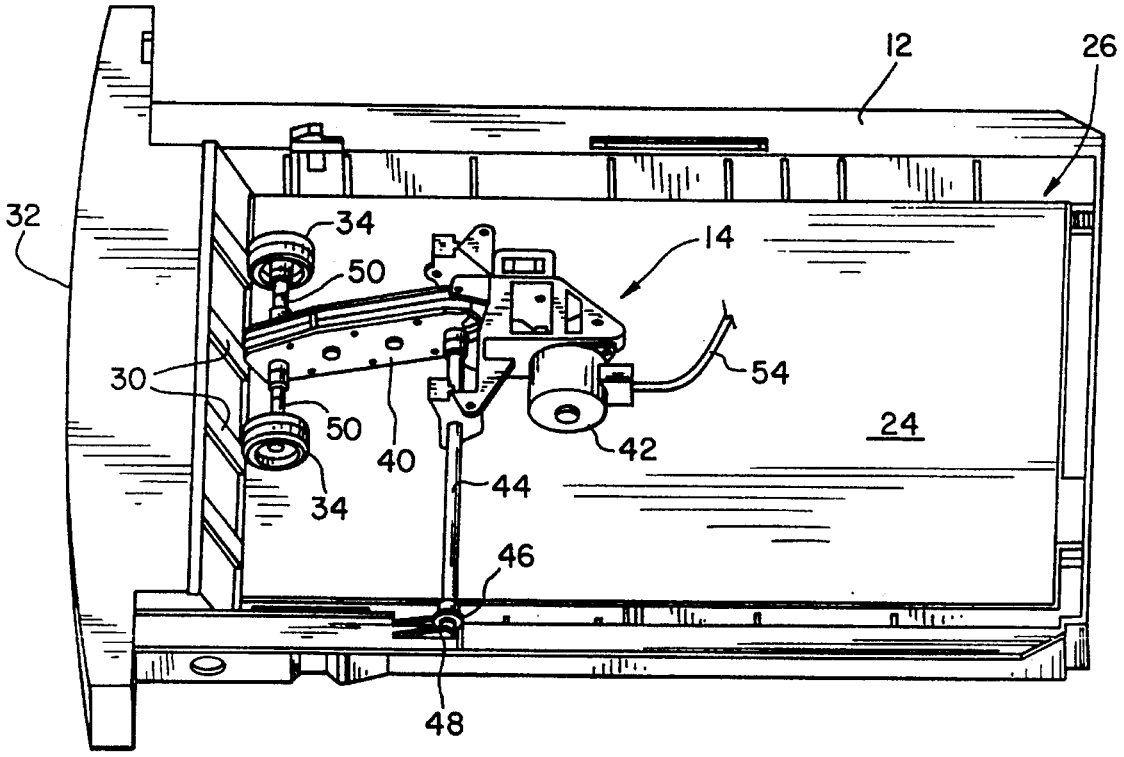
FIG. 2 is a perspective view of the supply tray and picker assembly shown in FIG. 1.

Referring now to FIG. 2, one embodiment of picker assembly 14 of the present invention is shown in greater detail. Picker assembly 14 rotates about a longitudinal axis of a pivot shaft 44 having a cam 46 at a distal end thereof. The longitudinal axis of pivot shaft 44 defines pivot point 38 (FIG. 1). Cam 46 engages a projecting surface 48 of supply tray 12, and is operable upon insertion and removal of supply tray 12 from printer 10 to swing picker assembly 14 up and out of the way for removal of supply tray 12. Cam 46 is also engageable by projecting surface 48 of supply tray 12 to allow pick rollers 34 to top a contact media sheet 24 upon insertion of supply tray 12 into printer 10. Drive train housing 40 includes a plurality of gears (not shown) which interconnect stepper motor 42 with output shafts 50 driving pick rollers 34. For details of a similar gear train which may be used or adapted for use with picker assembly 14 of the present invention, reference is made to U.S. patent application Ser. No. 08/406,233, entitled "Auto Compensating Paper Feeder", which is assigned to the assignee of the present invention and incorporated herein by reference.

Referring again to FIG. 1, sensor 16 within printer 10 is disposed in association with paper path 20 at a particular location such that a media sheet 24 may pass thereby. For example, sensor 16 may be located along paper path 20 prior to feed rollers 22 as shown by solid line, or alternatively may be located along paper path 20 at a point downstream of feed rollers 22 as indicated by dash lines and identified as sensor 16A. In some situations it may be desirable to include a sensor 16 (16A) at each location, but this is not required to practice the invention. Sensor 16 detects a leading edge of a media sheet 24 travelling through paper path 20 as media sheet 24 passes thereby. Sensor 16 is connected to processor 18 via conductor 52 and provides an output signal to processor 18 upon detecting the leading edge of a media sheet 24. In the embodiment shown, sensor 16 may be an optical or magnetic sensor which is actuated upon movement of a mechanical flag, such as an arm, upon engagement by the picked paper sheet, although other sensors may also be used.

Processor 18 generally is of known construction and may include various required or optional hardware, such as a microprocessor, RAM memory, data buffer, etc. Processor 18 controls operation of stepper motor 42 and in turn controls movement of pick rollers 34. More particularly, processor 18 provides a signal over conductor 54 which is used to control operation of stepper motor 42. Processor 18 also receives an output signal from sensor 16 indicating that a leading edge of a media sheet 24 has been sensed. Processor 18 monitors the time and/or distance of travel of media sheet 24 by monitoring the start of rotation of pick rollers 34 and the output signal from sensor 16. Processor 18 uses such times and/or distances to determine an approximate vertical position of an uppermost media sheet 24 of media stack 26 within supply tray 12 and with respect to bottom 28 of supply tray 12, and thereby infer a media level or height of media stack 26. Those skilled in the art will recognize that processor 18 could include multiple processors which are in communication with one another.

More particularly, it will be appreciated that the time or distance which any particular media sheet 24 travels before a leading edge 56 thereof reaches sensor 16 increases as the height "H" (FIG. 1) of media stack 26 decreases. This distance can be calculated by monitoring the start of operation of stepper motor 42, at which time a particular media sheet 24 was picked, and monitoring an output signal from sensor 16 by processor 18.

In the embodiment shown in FIG. 2, a single step of stepper motor 42 provides a known rotational output of stepper motor 42. Moreover, the gear ratio between the output of stepper motor 42 and pick rollers 34 is known and can be easily modified by changing the gear ratio of gears disposed within drive train housing 40. Thus, a single step of stepper motor 42 provides a known rotation of pick rollers 34. The rotation of pick rollers 34 can in turn be easily calculated as a distance using the circumference thereof. Each step of stepper motor 42 thus results in a known movement of a media sheet 24 along paper path 20, absent any slippage between the surface of roller 34 and sheet 24. By monitoring the number of steps that each media sheet 24 is moved since being picked, the number of steps of stepper motor 42 can be relatively easily converted into or used as an indication of a distance upon receipt of an output signal from sensor 16.

Of course, a motor which operates on a continuous basis at a known rotational speed can also be used by monitoring the time since a media sheet 24 is picked until an output signal is received from sensor 16. The time can be converted into a distance by using the known rotational speed of the motor, which in turn can be used to calculate or infer the distance travelled of a picked media sheet 24.

Also, if sensor 16 is positioned adjacent paper path 20 downstream of rollers 22 where, for example, the media sheet 24 is being conveyed by feed rollers 22 without the aid of rollers 34, then the time elapsing between the initiation of operation of rollers 34 and the indication of the presence of the sheet 24 by an output of sensor 16 can be converted into a distance by the known rotational speeds of rollers 34, the rotational speeds of rollers 22, and the circumferences of rollers 22 and 34. Because prior to the sheet arriving at rollers 22 the sheet 24 will not be traveling at a constant speed, some compensation for the acceleration characteristics of roller 34 may be required. This can be achieved, for example, by calculating the integral (I) of the velocity of the surface of roller 34 from the time movement of roller 34 is initiated ($t_0$) to the time of reaching the surface speed of rollers 22 ($t_1$) and adding integral (I) to a distance (D) the sheet travels during constant velocity. This distance (D) corresponds to the constant speed value multiplied by the elapsed time between the sensor 16 make-point time ($t_2$) and time ($t_1$). The integral (I) may either be actually calculated at real time, or may be estimated.

Processor 18 is connected via a single or multi-line conductor 59 to a display 58 for displaying an indication of the paper level of media stack 26 within supply tray 12. Such an indication may be in the form of a percentage full designation; an empty, near empty, full or other like designation; a bar graph or other graphical designation, etc. Moreover, display 58 can in fact be a display on a host computer in addition to or instead of being incorporated into printer 10 as shown in FIG. 1.

Processor 18 is also connected via a multi-line conductor 62 to a non-volatile memory 60, which preferably is in the form of a read only memory (ROM) or a programmable non-volatile memory such as an EEPROM or flash memory. Of course, memory 60 can be separate from processor 18 as shown, or can also be incorporated therewith. Memory 60 may include parameters stored therein which are associated with the vertical position of a media sheet 24 within supply tray 12. Such parameters may correspond to a distance or time from which a minimum number of media sheets within supply tray 12 (i.e., an "Empty" value), or a maximum number of media sheets 24 within supply tray 12 (i.e., a "Full" value), may be inferred. If time alone is used, then tables corresponding to each printer speed may be desired. Memory 60 may also include a look-up table which allows one or more of a plurality of data values corresponding to output signals from sensor 16 to be compared with comparison values in the look-up table.

Figure 3:
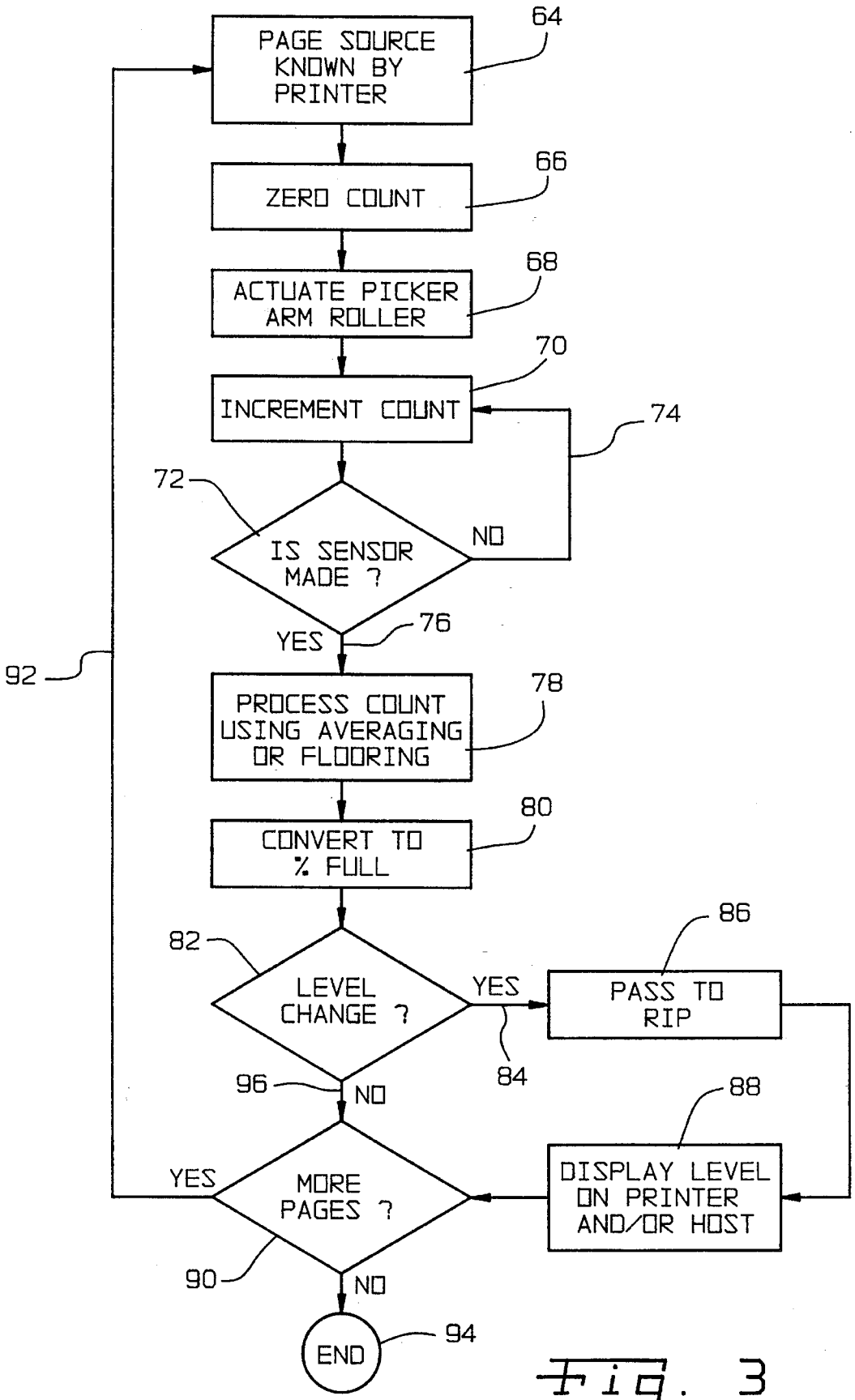
FIG. 3 is a flowchart of an embodiment of a method of the present invention for detecting a media level in a supply tray.

Referring now to FIG. 3, there is shown a flow chart of an embodiment of a method of the present invention for detecting a paper level in a supply tray where the sensor is positioned as sensor 16 of FIG. 1. First, printer 10 receives a print command, e.g., either manually or from a host computer, including information as to which page source or supply tray that printer 10 is to utilize (block 64). Processor 18 sets a zero count for the number of steps or time which stepper motor 42 is operated (block 66). Processor 18 then actuates stepper motor 42, which in turn actuates pick rollers 34 (block 68). Stepper motor 42 is stepped by one step and the count is incremented one numeric value such that the total count equals the number of steps moved by stepper motor 42 (block 70). A decision is then made as to whether sensor 16 has sensed the leading edge of the corresponding picked paper sheet (decision block 72). If sensor 16 has not yet sensed the leading edge of the picked paper sheet (i.e., processor 18 has not received an output signal from sensor 16 via conductor 52), then pick roller 34 is moved again by stepping stepper motor 42 (line 74), and the count is incremented again by one. On the other hand, if sensor 16 had sensed the leading edge of a media sheet 24 (line 76), then the data values of the signals received from sensor 16 by processor 18 are mathematically operated upon using an averaging or flooring technique (block 78).

Alternatively, a free running counter incrementing at a known rate may be used, wherein such a counter begins incrementing at the start of rotation of roller 34, and continues to increment its count until sensor 16 detects the leading edge 56 of media sheet 24.

The averaging or flooring techniques are used to inhibit an erratic datum value from erroneously causing an improper paper level indication to be sent to a user. To wit, data values corresponding to output signals received by processor 18 from sensor 16 may be stored in processor 18, such as in a RAM memory (not shown). It will be appreciated that it may be possible for some slippage to result between pick rollers 34 and a top media sheet 24, thereby occasionally resulting in an erratic datum value. Processor 18 performs a mathematical operation on a discrete number N of stored data values so that the effect of an erratic datum value is reduced. For example, processor 18 may perform an averaging computation on every four data values (or other discrete number of data values ranging, e.g., between 3 and 10 data values) to reduce the effect of an erratic datum value. If the current datum value falls within the range of upper and lower thresholds or comparison values stored in a look-up table in memory 60, then the average of the previous N data values is used as an indication of the paper level within supply tray 12. On the other hand, if the current datum value is outside of a threshold or comparison values stored in memory 60 (such as may occur because of slippage between pick rollers 34 and media sheet 24), then the minimum data value of the discrete number of data values is used as an indication of the paper level within supply tray 12 (hence the name "flooring"). In embodiments in which memory 60 includes a reprogrammable memory unit, the threshold values may be updated based upon such factors as, for example, variations in manufacturing tolerances and wear. Of course, it will be appreciated that other techniques for reducing the effect of erratic data values can also be employed and are within the scope of this invention. Moreover, for certain applications, it may not even be necessary to consider the effect of erratic data values.

Continuing with the description of FIG. 3, the count which is processed using the above-described averaging or flooring technique (block 78) is converted to an indication of the paper level within supply tray 12, such as a percent full indication (block 80). A determination is then made as to whether the paper level changed from one level to another (decision block 82). Of course, the type of level indication and sensitivity of level indication may be varied from one application to another. If the determination from one level change to another is YES (line 84), then the new level indication is passed to a Raster Image Processor or RIP (block 86) of printer 10 (RIP is not shown in FIG. 1), which in turn causes the new paper level indication to be displayed on display 58 of printer 10 and/or a display screen of a host computer (block 88). Thereafter, a determination is made as to whether or not additional pages are to be printed (decision block 90), with control passing back to block 64 via line 92 if the answer is YES, and ending at 94 if the answer is NO.

On the other hand, if the determination as to whether or not a level change occurred at decisional block 82 was NO (line 96), then control passes directly to decisional block 90 with the resultant decisional step as to whether more pages exist, as described above.

Figure 4:
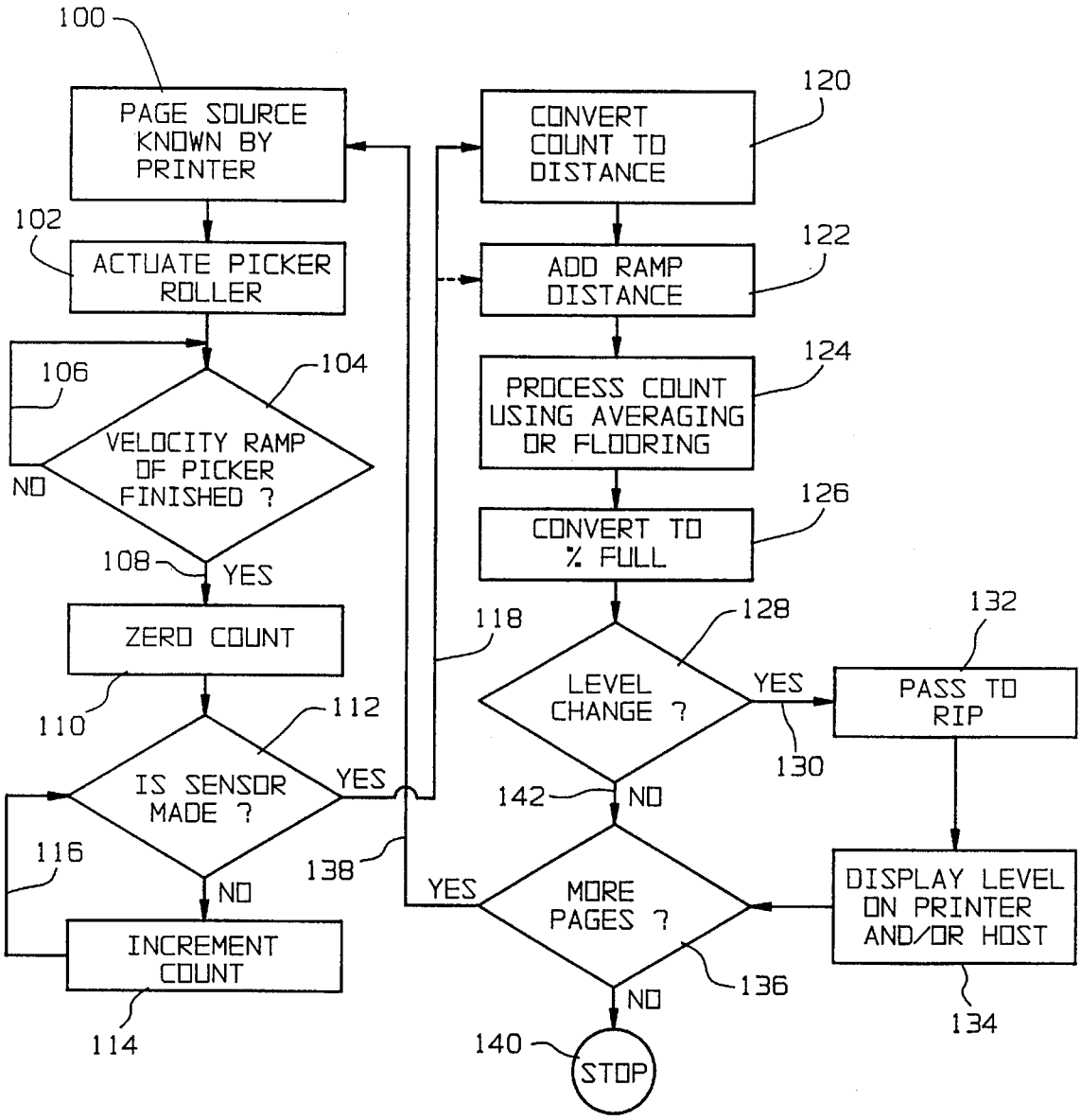
FIG. 4 is a flowchart of an alternative method of the present invention for detecting a media level in a supply tray.

Referring now to FIG. 4, there is shown a flowchart of an alternative embodiment of the method of the present invention for detecting a paper level in a supply tray where the sensor is positioned corresponding to that of sensor 16A in FIG. 1. Although not readily apparent from FIG. 1, the position of sensor 16A is intended to correspond to a position in which the trailing edge of a media sheet 24 disengages from pick rollers 34 prior to being sensed by sensor 16A. Thus, it is necessary that media sheet 24 be moved through the paper path after disengaging from pick rollers 34, such as by using rollers 22 in a paper feed assembly. It will be appreciated by those skilled in the art that it will most likely be desirable to stop pick rollers 34 slightly prior to or when media sheet 24 is disengaged therefrom, such that the next media sheet 24 is not moved into the paper path until desired. The distance traveled by the leading edge of a picked media sheet 24 prior to being sensed by sensor 16A is therefore a function of both the circumferential distance moved by pick rollers 34 prior to stopping, as well as the distance moved by feed rollers 22 between the stopping of pick rollers 34 and sensing of the leading edge of media sheet 24 by sensor 16A.

First, printer 10 receives a print command, e.g., either manually or from a host computer, including information as to which page source or supply tray that printer 10 is to utilize (block 100). Processor 18 actuates stepper motor 42, which in turn actuates pick rollers 34 (block 102). Stepper motor 42 starts from a zero velocity and accelerates to a known velocity corresponding to an operating speed of a paper feed assembly, including rollers 22. This acceleration results in picker rollers 34 exhibiting one of a plurality of possible velocity ramps or profile curves, as is known. Dependent on the particular velocity curve exhibited by pick rollers 34, a certain number of steps or a predetermined period of time occurs before pick rollers 34 reach the substantially constant velocity at which the paper feed assembly also operates. A decision is thus made as to whether the velocity ramp of pick rollers 34 has finished or leveled off (decision block 104). If pick rollers 34 are still accelerating, i.e., the velocity ramp of pick rollers 34 has not yet finished, then a wait state results as indicated by line 106. On the other hand, if the velocity ramp of pick rollers 34 is finished (line 108), processor 18 sets a zero count for the number of steps or time which stepper motor 42 is operated (block 110). A decision is then made as to whether sensor 16A has sensed the leading edge of the corresponding picked paper sheet (decision block 112). If sensor 16A has not yet sensed the leading edge of the picked paper sheet (i.e., processor 18 has not received an output signal from sensor 16A via conductor 52A), then the count is incremented by one (block 114) and control passes back to decision block 112 via line 116. On the other hand, if sensor 16A has sensed the leading edge of a media sheet 24 (line 118), then control passes to either block 120 if the basis for determining movement of pick rollers 34 is time, or block 122 if the basis for determining movement of pick rollers 34 is distance. It will be appreciated that if the basis for determining movement of pick rollers 34 is distance and control passes from decision block 112 to block 122 (as indicated by the phantom line portion of line 118), then block 120 is not utilized.

In the event that the value of count is dependent upon time, then a mathematical conversion is carried out in block 120 which converts the time (or count) into a distance using the known rotational speed of motor 42 and the gearing between motor 42 and pick rollers 34. In block 122, the distance corresponding to the distance which a picked paper sheet 24 moves during the velocity ramp of pick rollers 34 is added to the distance moved by the paper sheet corresponding to the value of "count". In general, this consists of adding a predetermined distance (which is likely empirically determined) corresponding to the distance traveled by media sheet 24 during the velocity ramp of pick rollers 34 (block 124). Such processing using an averaging or flooring technique is generally the same as that described with regard to the description of block 78 in FIG. 3. The count which is processed using the averaging or flooring technique (block 124) is converted to an indication of the paper level within supply tray 12, such as a percent full indication (block 126). A determination is then made as to whether the paper level changed from one level to another (decision block 128). Of course, the type of level indication and sensitivity of level indication may be varied from one application to another. If the determination from one level change to another is YES (line 130) then the new level indication is passed to a RIP (block 132) of printer 10, which in turn causes the new paper level indication to be displayed on display 58 of printer 10 and/or a display screen of a host computer (block 134). Thereafter, a determination is made as to whether or not additional pages are to be printed (decision block 136), with control passing back to block 100 via line 138 if the answer is YES, and ending at 140 if the answer is NO.

On the other hand, if the determination as to whether or not a level change occurred at decision block 128 was NO (line 142), then control passes directly to decision block 136 with the resultant decisional step as to whether more pages exist, as described above.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus including a supply tray having a base upon which a plurality of media sheets is supported, said apparatus defining a media path through which the media sheets travel, said apparatus comprising:

a sheet picker assembly including a movable sheet picker, said picker configured to move a picked sheet into the media path;

a sensor disposed in association with the media path at a sensor location, said sensor adapted to detect a sheet traveling through the media path and provide an output signal; and a processor coupled to each of said picker assembly and said sensor, wherein said processor controls movement of said movable picker and receives said sensor output signal, and wherein said processor determines a relative position of an uppermost sheet of a remainder of the plurality of media sheets with respect to the base of the supply tray, based upon an initial actuation of said sheet picker to pick said picked sheet and a sensing of said picked sheet arriving at said sensor.

2. The apparatus of claim 1, wherein said position of the uppermost sheet corresponds to a height of a remainder of the media sheets within the supply tray.

3. The apparatus of claim 1, wherein said picker assembly further includes a motor and wherein said movable picker comprises a pick roller, said motor coupled to and rotatably driving said pick roller, said processor connected to and controlling operation of said motor.

4. The apparatus of claim 3, wherein said motor comprises a stepper motor, and wherein said processor determines said position of the picked sheet within the supply tray dependent on a number of steps of said stepper motor since the picked sheet detected by said sensor was first moved by said pick roller.

5. The apparatus of claim 1, wherein said processor determines said relative position of the uppermost sheet within the supply tray dependent on an elapsed time since the picked sheet detected by said sensor was first moved by said sheet picker.

6. The apparatus of claim 1, wherein said processor determines said relative position of the uppermost sheet within the supply tray dependent upon a distance said picked sheet travels to reach said sensor.

7. The apparatus of claim 1, wherein said picked sheet is transported along said media path by at least one feed roller.

8. The apparatus of claim 7, wherein said sensor location is adjacent said media path and upstream of said at least one feed roller.

9. The apparatus of claim 7, wherein said sensor location is adjacent said media path and downstream of said at least one feed roller.

10. The apparatus of claim 1, wherein said movable picker comprises a rotatable pick roller.

11. The apparatus of claim 1, wherein said processor provides an output signal corresponding to said relative position of the uppermost media sheet remaining within the supply tray.

12. The apparatus of claim 1, wherein said sensor detects a leading edge of the picked sheet traveling through the media path.

13. The apparatus of claim 1, wherein said sensor comprises one of an optical sensor and magnetic sensor.

14. The apparatus of claim 1, wherein said processor includes one of an integral non-volatile memory and separate non-volatile memory for storing parameters associated with said relative position of the uppermost sheet within the supply tray.

15. The apparatus of claim 14, wherein said non-volatile memory comprises a programmable non-volatile memory.

16. The apparatus of claim 14, wherein said parameters correspond to one of a distance and time from which a minimum number of the sheets within the supply tray and a maximum number of the sheets within the supply tray may be inferred.

17. A method of determining a media level of a media stack in a supply tray of an apparatus, the apparatus including a picker assembly with a picker controlled by a processor for picking a media sheet from said media stack, the apparatus defining a media path through which a picked sheet selected from said media stack travels, said method comprising the steps of:

providing a sensor disposed in association with the media path at a location, said sensor coupled to said processor;

moving the picked sheet from the supply tray into the media path using said picker assembly;

sensing the picked sheet traveling through the media path with said sensor;

transmitting an output signal from said sensor to said processor indicating that the presence of said picked sheet has been sensed; and determining the media level within the supply tray using said processor, dependent on said sensor output signal and an initial actuation of said sheet picker to pick a sheet.

18. The method of claim 17, wherein said determining step further comprises the step of determining a distance said picked sheet travels to reach said sensor.

19. The method of claim 17, wherein said determining step further comprises the step of determining an elapsed time since the picked sheet sensed by said sensor was first moved by said picker.

20. The method of claim 17, comprising the further steps of sequentially repeating said moving, sensing, transmitting and determining steps.

21. The method of claim 20, comprising the further steps of storing a look-up table in a memory, and comparing at least one data value corresponding to at least one of said transmitted output signals with a comparison value in said stored look-up table.

22. The method of claim 21, wherein said at least one data value comprises a plurality of data values, and comprising the further step of performing a mathematical operation on a discrete number of said plurality of data values.

23. The method of claim 22, wherein said mathematical operation comprises at least one of an addition and division.

24. The method of claim 22, wherein said discrete number of said stored data values is selected from a range between 3 and 10 stored data values.

25. The method of claim 22, further comprising the step of averaging said discrete number of said plurality of data values.

26. The method of claim 25, further comprising the step of establishing a range of threshold values, wherein if a current datum value falls within said range of threshold values, then an average of said discrete number of said plurality of data values is used by said processor to effect an indication of said media level in said supply tray.

27. The method of claim 21, further comprising the step of establishing a range of threshold values and said at least one data value comprises a plurality of data values, wherein if a current datum value falls outside said range of threshold values, then a minimum data value of a discrete number of said plurality of data values is used by said processor to effect indication of the media level in said supply tray.

28. An apparatus including a supply tray having a base upon which a plurality of media sheets is supported, said apparatus defining a media path through which the media sheets travel, said apparatus comprising:

a sheet picker assembly including a movable sheet picker, said picker configured to move a picked sheet into the media path;

a sensor disposed in association with the media path at a sensor location, said sensor adapted to detect a sheet traveling through the media path and provide an output signal; and a processor coupled to each of said picker assembly and said sensor, wherein said processor monitors and controls movement of said movable picker and receives said sensor output signal, and wherein said processor determines a relative position of an uppermost sheet of a remainder of the plurality of media sheets with respect to the base of the supply tray, based upon the monitor of said sheet picker picking said picked sheet and a sensing of said picked sheet arriving at said sensor.

* * * * *